US007370376B2

(12) United States Patent
Chou

(10) Patent No.: US 7,370,376 B2
(45) Date of Patent: May 13, 2008

(54) TRANSFER MATTRESS

(75) Inventor: Chao-Mu Chou, Taipei (TW)

(73) Assignees: Shiu-Yin Cheng, Taipei (TW); Ching-Yu Chou, Taipei (TW)

( * ) Notice: Subject to any disclaimer, the term of this patent is extended or adjusted under 35 U.S.C. 154(b) by 0 days.

(21) Appl. No.: 11/639,287

(22) Filed: Dec. 15, 2006

(65) Prior Publication Data

US 2007/0151024 A1 Jul. 5, 2007

(30) Foreign Application Priority Data

Jan. 5, 2006 (TW) ..... 95200215 U

(51) Int. Cl.
*A61G 7/08* (2006.01)
*A61G 7/14* (2006.01)

(52) U.S. Cl. ..... 5/81.1 HS; 5/81.1 C

(58) Field of Classification Search ..... 5/81.1 HS, 5/81.1 C, 81.1 T, 81.1 R, 925, 926
See application file for complete search history.

(56) References Cited

U.S. PATENT DOCUMENTS

| | | | | |
|---|---|---|---|---|
| 3,769,642 | A * | 11/1973 | Warman | 5/81.1 T |
| 6,012,183 | A * | 1/2000 | Brooke et al. | 5/81.1 HS |
| 6,374,435 | B1 * | 4/2002 | Leininger et al. | 5/81.1 HS |
| 6,823,542 | B2 * | 11/2004 | Berge | 5/81.1 HS |
| 6,845,529 | B2 * | 1/2005 | Berge | 5/81.1 HS |
| 7,020,912 | B2 * | 4/2006 | Berge | 5/81.1 HS |
| 2004/0172751 | A1 * | 9/2004 | Berge | 5/81.1 HS |
| 2005/0102750 | A1 * | 5/2005 | Berge | 5/81.1 HS |
| 2007/0151024 | A1 * | 7/2007 | Chou | 5/81.1 HS |

* cited by examiner

*Primary Examiner*—Robert G. Santos
(74) *Attorney, Agent, or Firm*—Troxell Law Office, PLLC

(57) ABSTRACT

The present invention discloses a transfer mattress, comprising a mattress which is a rectangular body encompassed with a movable tubular fabric sleeve and dimensioned for a person to lie down; and at least a pull strap having a first joint secured on the tubular fabric sleeve and encircled around the tubular fabric sleeve with some extra length and a second joint secured on the tubular fabric sleeve at a different or the same point with the first joint.

12 Claims, 7 Drawing Sheets

TRANSFER MATTRESS

FIELD OF THE INVENTION

The present invention relates to a transfer mattress and in particular to a mattress set suitable, but not limited, to move patients.

BACKGROUND OF THE INVENTION

People are destined to get sick sometimes and external injury also occurs one in a while. Consequently, establishing a comprehensive medical system is important and requires constant attention. Furthermore, the peripheral equipments for patients are as important as related medical professionals and medical facilities for the establishing of a good medical system.

Moving a patient, for example, is a commonly seen in a medical treatment such as transferring a patient from a hospital bed to an operating table. For patients, unlike their healthy counterparts, it is difficult and painful for them to be moved around. Pains are likely to occur and thus medical quality may be reduced as a result of transferring them from one place to another improperly. As for caregivers, there are a lot of chances of back or other injuries which caused by an improper way to move patient. It is therefore important to have a good way of smooth transfer of patients.

SUMMARY OF THE INVENTION

Consequently, the present applicant has attempted to find a solution for the subject and filed an application titled as Sliding Mattress, which has been listed as a Taiwanese Utility Model application No. 094218391, and currently under review. The applicant has continuously worked on to find a better solution and, after numerous trials, invented the present "Transfer Mattress." It is therefore a primary aspect of the invention to provide a transfer mattress, comprising: a mattress which is a rectangular body encompassed with a movable tubular fabric sleeve and dimensioned for a person to lie down; and at least a pull strap having a first joint secured on the tubular fabric sleeve and encircled around the tubular fabric sleeve with some extra length and a second joint secured on the tubular fabric sleeve at a different or the same point with the first joint.

According to the second aspect of the present invention, wherein the pull strap has two straps positioned at the middle of the tubular fabric sleeve.

According to the third aspect of the present invention, wherein the first joint and the second joint of the pull strap are positioned at the same point.

According to the fourth aspect of the present invention, wherein the first joint and the second joint of the pull strap are positioned at the different point.

According to the fifth aspect of the present invention, wherein the first joint and/or the second joint of the pull strap is a Y-shape strap with two securing points on the pull strap.

According to the sixth aspect of the present invention, wherein the material of the strap is the same with that of the tubular fabric sleeve.

According to the seventh aspect of the present invention, wherein the material of the pull strap and the tubular fabric sleeve is nylon.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DETAILED DESCRIPTION OF THE INVENTION

Figure 1:
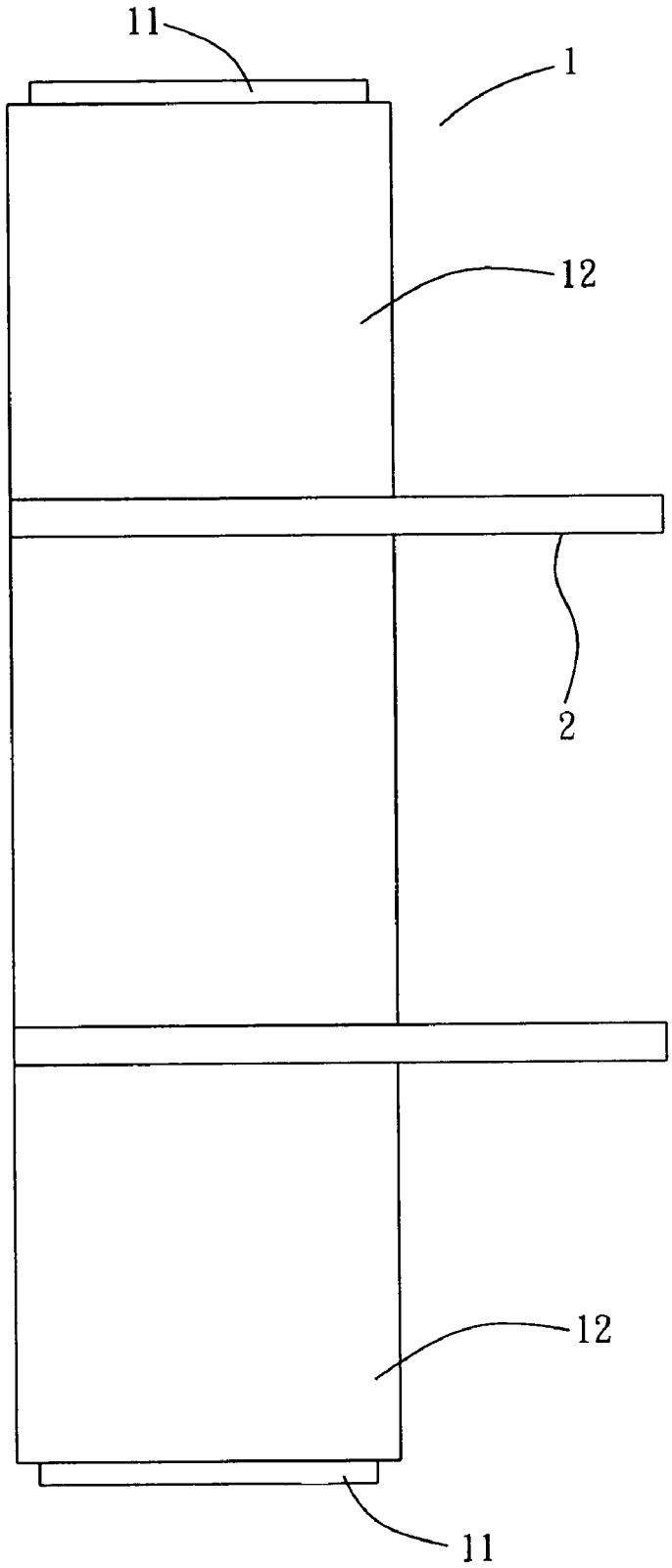
FIG. 1 schematically illustrates a front view of a transfer mattress according to the present invention.
Figure 2:
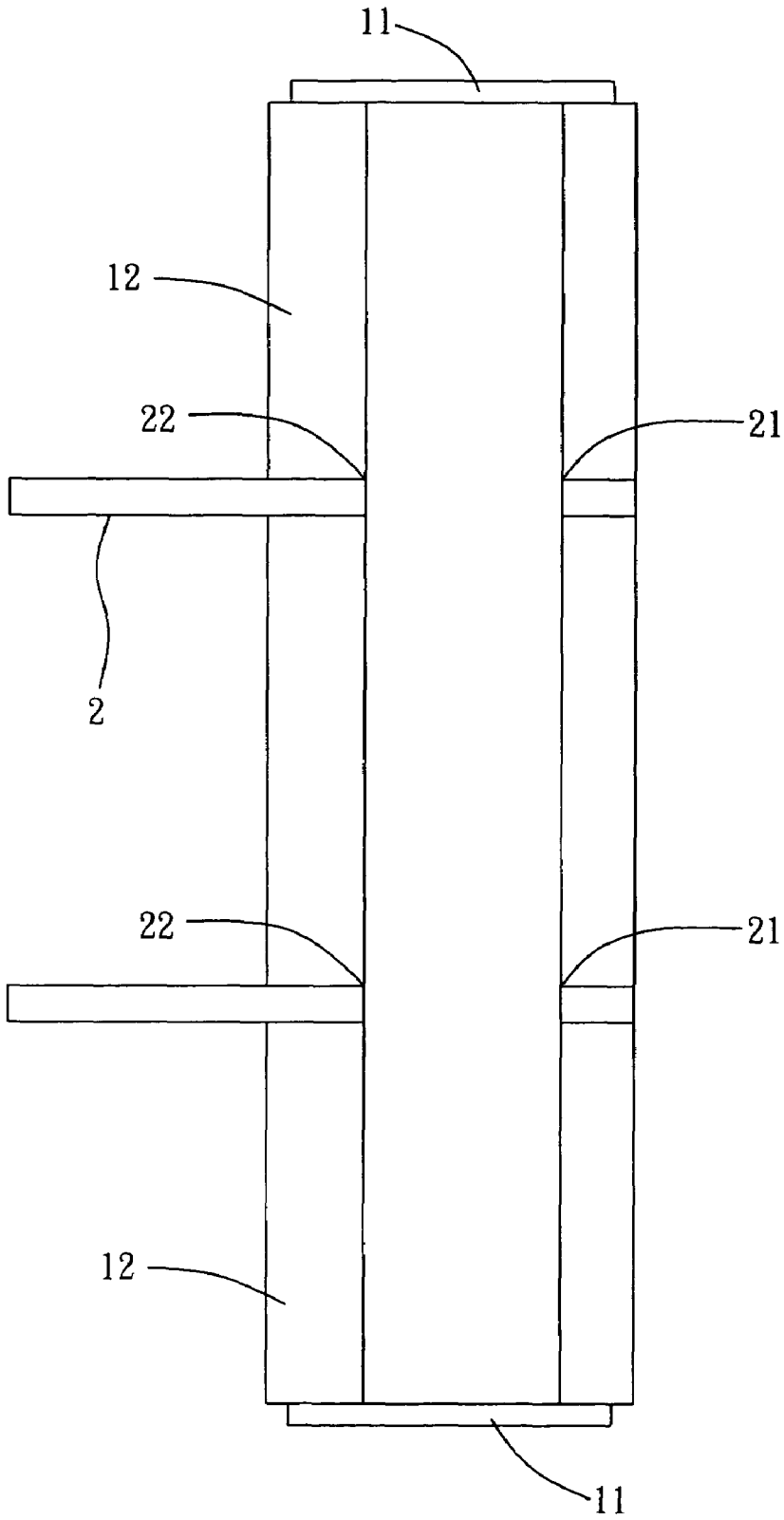
FIG. 2 schematically illustrates a rear view of a transfer mattress according to the present invention.
Figure 3:
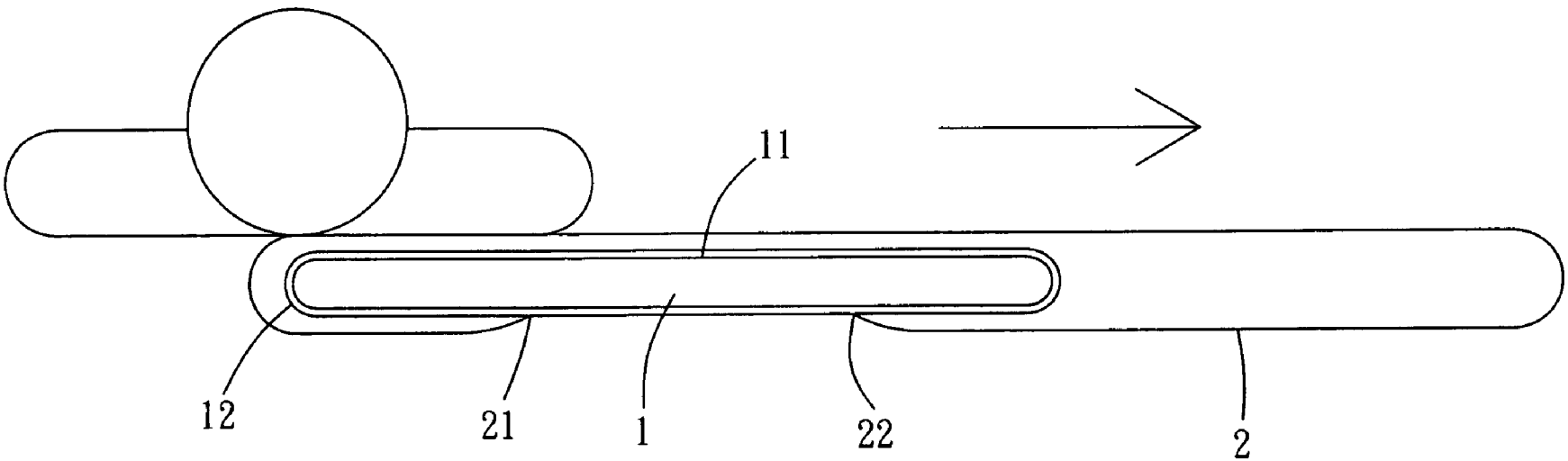
FIG. 3 schematically illustrates a transfer mattress according to the present invention being inserted under a patient.
Figure 4:
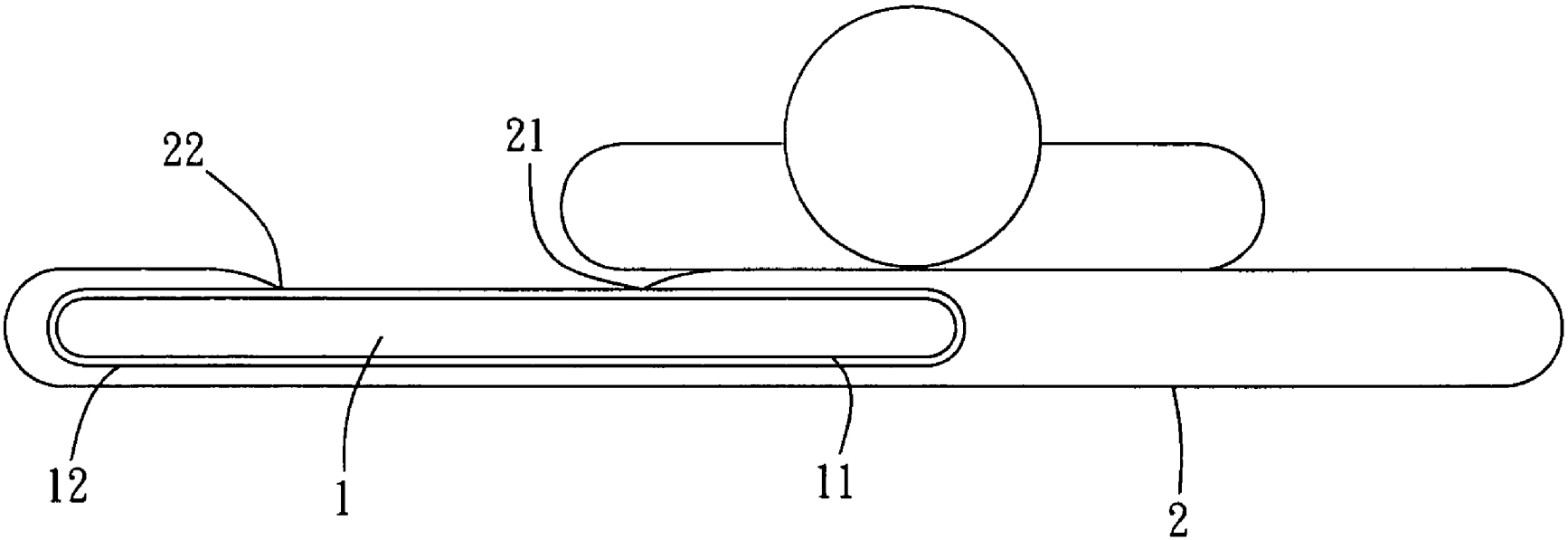
FIG. 4 schematically illustrates transferring a patient by pulling the pull strap of a transfer mattress according to the present invention.
Figure 5:
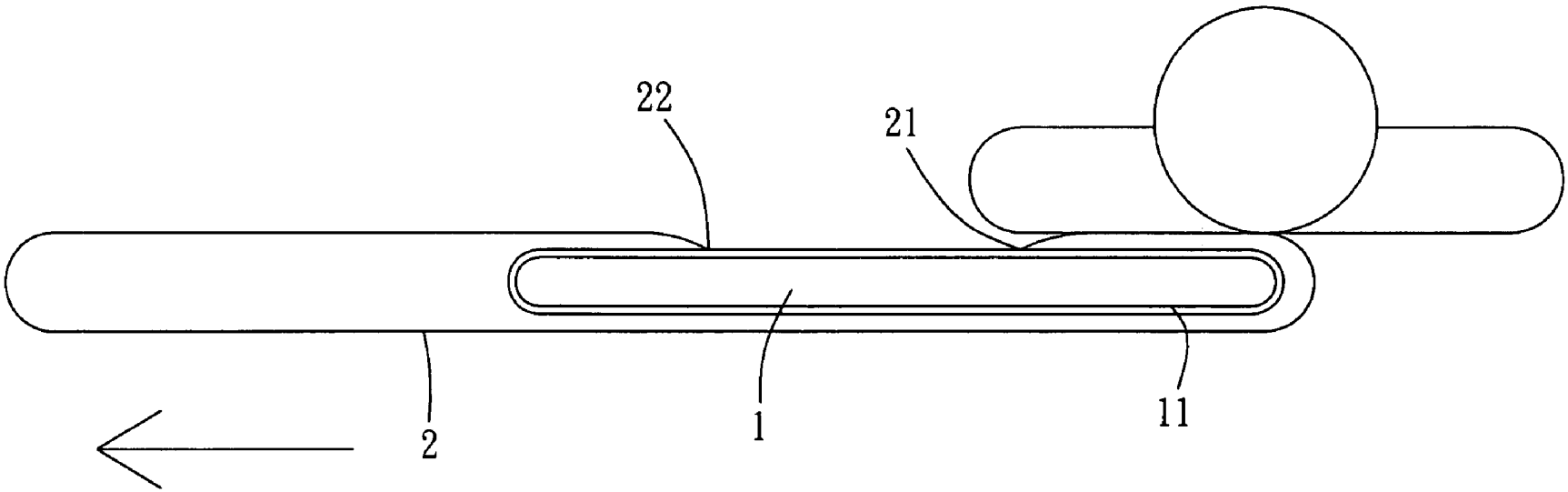
FIG. 5 schematically illustrates the position of a patient after the pull strap of a transfer mattress according to the present invention being pulled.
Figure 6:
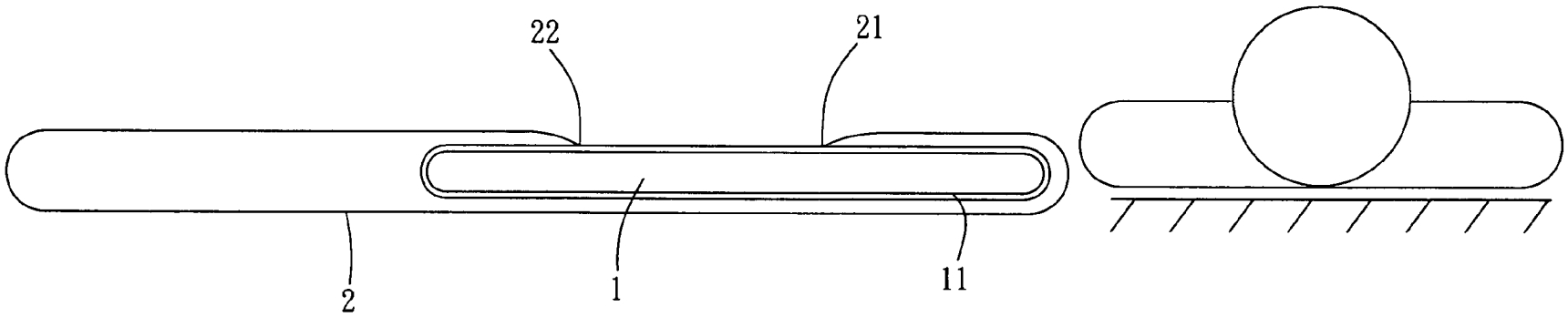
FIG. 6 schematically illustrates the position of a patient after being transferred from a transfer mattress according to the present invention to another mattress.

With reference to the FIGS. 1 to 6, a transfer mattress according to the present invention comprises a mattress 1 and a pull strap 2, wherein the mattress 1 is a rectangular body which is dimensioned for a person to lie down. In an embodiment of the present invention, the mattress 1 may comprise an inner cushion 11 with a tubular fabric sleeve 12 tubular encompassing the inner cushion 11. The fabric sleeve 12 may be made of, for example but not limited to, stripe nylon, which may be rotated with respect to the inner cushion 11.

The pull strap 2, which may be a single piece attached to the middle of the tubular fabric sleeve 12; alternatively, the pull strap 2 may comprise two pieces, as shown in the present embodiment. One end of the pull straps 2 is secured on the tubular fabric sleeve 12 to form a first joint 21 and other end is encircled around the tubular fabric sleeve 12 and then secured on the tubular fabric sleeve 12 to form a second joint 22 with some extra length of the strap over the tubular fabric sleeve 12. In fact, the second joint 22 may be positioned at the same point with the first joint 21, i.e., the first and second joints 21, 22 are preferably not to be overlapped. As shown in the present embodiment of the present invention, the first joint 21 and the second joint 22 are positioned at different points and the extra length is roughly equal to the width of the mattress 1. The material of the pull strap 2 is, preferably but not limited to, the same with that of the tubular fabric sleeve 12. At least one end of the at least one pull strap may be detachably connected to the tubular fabric sleeve.

With reference to the figures, when the present invention is being operated, the first joint 21 of the present invention facing downward is inserted under a patient. When the tubular fabric sleeve of the present invention is positioned at the right position, the pull strap 2 is pulled on its top to rotate the tubular fabric sleeve 12 with respect to the mattress 1, such that the patient's body is being moved on the mattress 1 automatically as a result of the rotation of the tubular fabric sleeve 12. When half of the patient's body is being transferred to another bed, for example but not limited to an operation bed, the present invention may then be removed and the patient is transferred successfully.

Figure 7:
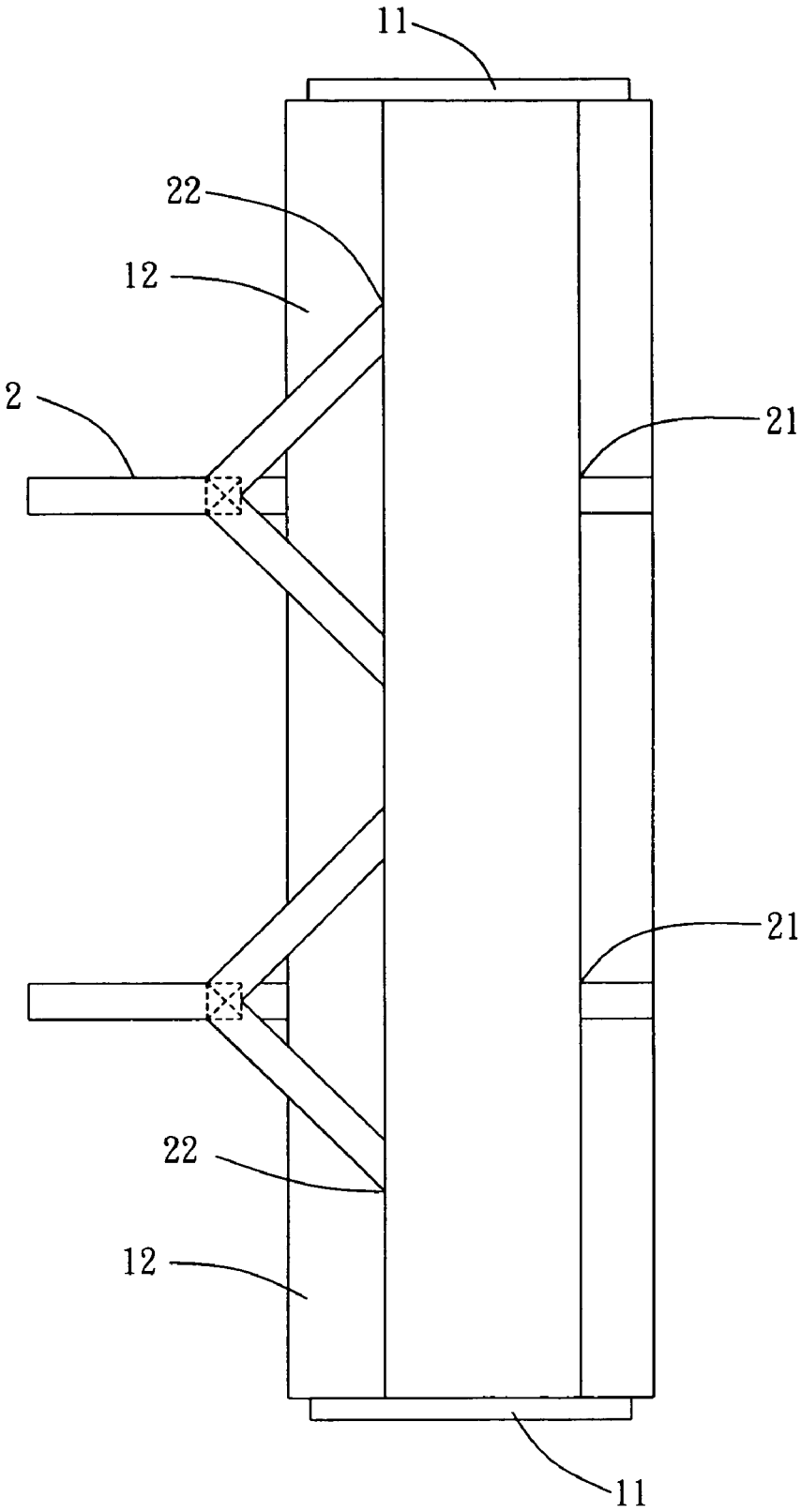
FIG. 7 schematically illustrates another embodiment of the pull strap of a transfer mattress according to the present invention.

Furthermore, with reference to FIG. 7, the first joint 21 and/or the second joint 22 of the pull strap 2 may be a Y-shape strap with two securing points to increase strength.

With the implementation of the present invention, the conventional labor-consuming way of moving patients can be improved. The present invention can be used to transfer patients easily, safely and avoiding the risk of back or other injuries to caregivers; even a single caregiver can achieve transferring a patient, as proved by a field test.

While the invention has been described with reference to the a preferred embodiment thereof, it is to be understood that modifications or variations may be easily made without departing from the spirit of this invention, which is defined by the appended claims.

What is claimed is:

1. A transfer mattress comprising:

a) a mattress being a rectangular body and having a size for a person to lie down, the mattress having i) an inner cushion; and ii) a tubular fabric sleeve, the inner cushion is slidably inserted into the tubular fabric sleeve, and the tubular fabric sleeve is rotatable with respect to the inner cushion; and b) at least one pull strap having a first joint located on a first end thereof and a second joint located on a second end thereof, the first joint and the second joint are connected to the tubular fabric sleeve, the at least one pull strap extending around of an exterior periphery of the tubular fabric sleeve a predetermined distance, a length of the at least one pull strap is longer than the predetermined distance that the at least one pull strap extends around the tubular fabric sleeve.

2. The transfer mattress according to claim 1, wherein the at least one pull strap includes two pull straps positioned at a middle of the tubular fabric sleeve.

3. The transfer mattress according to claim 1, wherein the first joint and the second joint are located at a same position.

4. The transfer mattress according to claim 1, wherein the first joint and the second joint are spaced apart.

5. The transfer mattress according to claim 1, wherein the first joint of the at least one pull strap has a Y-shaped strap with two securing points connected to the tubular fabric sleeve.

6. The transfer mattress according to claim 1, wherein the second joint of the at least one pull strap has a Y-shaped strap with two securing points connected to the tubular fabric sleeve.

7. The transfer mattress according to claim 1, wherein each of the first joint and the second joint of the at least one pull strap has a Y-shaped strap with two securing points connected to the tubular fabric sleeve.

8. The transfer mattress according to claim 1, wherein the at least one pull strap and the tubular fabric sleeve are made of a same material.

9. The transfer mattress according to claim 1, wherein the pull strap and the tubular fabric sleeve are nylon.

10. The transfer mattress according to claim 1, wherein at least one end of the at least one pull strap is detachably connected to the tubular fabric sleeve.

11. The transfer mattress according to claim 1, wherein, when the tubular fabric sleeve is rotated by applying a force to the at least one pull strap, the inner cushion slides within the tubular fabric sleeve and moves in a same direction as the force applied to the at least one pull strap.

12. The transfer mattress according to claim 1, wherein the inner cushion has a length longer than a length of the tubular fabric sleeve.

* * * * *